United States Patent [19]

Chekroun

[11] 4,320,404

[45] Mar. 16, 1982

[54] MICROWAVE PHASE SHIFTER AND ITS APPLICATION TO ELECTRONIC SCANNING

[75] Inventor: Claude Chekroun, Bures Sur Yvette, France

[73] Assignee: Societe d'Etude du Radant, Orsay, France

[21] Appl. No.: 237,642

[22] Filed: Feb. 24, 1981

Related U.S. Application Data

[63] Continuation of Ser. No. 971,546, Dec. 20, 1978.

[30] Foreign Application Priority Data

Dec. 20, 1977 [FR] France ..... 77 38354

[51] Int. Cl.[3] ..... H01Q 3/26

[52] U.S. Cl. ..... 343/854; 343/754; 343/786

[58] Field of Search ..... 343/854, 754, 756, 909, 343/755, 757, 778; 333/21, 24.1, 24.3, 98

[56] References Cited

U.S. PATENT DOCUMENTS

| | | | |
|---|---|---|---|
| 3,276,023 | 9/1966 | Dorne et al. | 343/854 |
| 3,569,974 | 3/1971 | McLeod Jr. | 343/854 |
| 3,708,796 | 1/1973 | Bony | 343/754 |
| 4,212,014 | 7/1980 | Chekroun | 343/754 |
| 4,266,203 | 5/1981 | Saudrean et al. | 343/756 |

FOREIGN PATENT DOCUMENTS

| | | |
|---|---|---|
| 1329686 | 5/1962 | France . |
| 2224887 | 10/1974 | France . |

OTHER PUBLICATIONS

Hanson, *Microwave Scanning Antennas,* vol. III, 1966, pp. 102–121.

*Primary Examiner*—David K. Moore

*Attorney, Agent, or Firm*—Finnegan, Henderson, Farabow, Garrett and Dunner

[57] ABSTRACT

A plurality of metallic wire conductors are fitted in shunt along a shorted wave guide parallel to a dielectric field of electromagnetic wave incident to the wave guide. At least some of the wires have diodes mounted on them such that selective biasing of the diodes renders these wires discontinuous and causes a controlled phase shift of the incident wave.

10 Claims, 6 Drawing Figures

| | |
|---|---|
| 0 0 0 1 1 0 1 | 1 1 0 1 1 0 0 |
| 1 1 0 0 0 1 0 | 1 1 0 0 1 1 0 |
| 1 1 1 1 1 0 1 | 0 1 0 0 1 1 0 |
| 0 0 1 1 0 1 1 | 1 0 0 0 1 1 0 |
| 0 1 1 1 1 1 1 | 0 0 1 1 1 1 0 |
| 0 0 1 1 1 1 1 | 1 0 0 0 0 1 0 |
| 1 0 0 0 0 1 1 | 0 0 0 1 1 1 0 |
| 1 1 0 0 0 1 1 | 1 1 1 1 1 1 0 |
| 1 1 0 0 1 1 1 | 0 0 1 0 1 1 0 |
| 1 0 1 0 0 0 1 | 1 1 0 1 1 1 0 |
| 1 1 1 0 0 0 1 | 1 0 1 1 1 1 0 |
| 1 1 1 0 0 1 1 | 1 1 1 0 1 1 0 |
| 0 0 0 0 0 0 1 | 0 0 1 1 0 1 0 |
| 1 1 0 1 0 0 0 | 0 0 0 1 0 1 0 |
| 1 0 1 1 0 0 0 | 1 1 1 1 0 1 0 |
| 1 1 1 1 0 0 0 | 1 0 0 0 1 0 0 |
| 0 0 0 1 0 0 0 | 0 0 1 1 1 0 0 |
| 1 1 1 0 1 0 0 | 0 0 0 1 1 0 0 |
| 0 0 1 0 1 0 0 | 1 1 1 1 1 0 0 |

0: Lines of reverse biased diodes

1: Lines of forward biased diodes

MICROWAVE PHASE SHIFTER AND ITS APPLICATION TO ELECTRONIC SCANNING

This is a continuation of application Ser. No. 971,546, filed Dec. 20, 1978.

BACKGROUND OF THE INVENTION

The present invention relates to an electronically controlled microwave phase shifter.

There exist today several types of phase shifters permitting the control of phase variations in a microwave signal. Known phase shifters include diode phase shifters and ferrite phase shifters which work by the modification of magnetic permeability.

Diode phase shifters typically present a fundamental inconvenience in that the minimum difference between two phase values such shifters are able to obtain remains high. Typically, for technological reasons and cost, the minimum difference is greater than 22.5 degrees. In order to diminish this minimum difference, it would of course be possible to increase the number of diodes in the phase shifter, but this would lead, on the other hand, to inadmissible energy losses and to operation which is limited to a very narrow band of frequencies. Furthermore, diode phase shifters require the use of components of very advanced technology and of high costs especially when one wishes to operate above 8000 MHz.

Theoretically, ferrite phase shifters allow for continuous variation of the phase of a microwave signal. Practically, they permit all useful phase variations (up to 5 degrees) in present industrial applications. Nevertheless they present a number of inconveniences, arising from their principles of operation, namely: (a) complexity of drive circuitry necessary for the production of the variable magnetic field, (b) large switching time, and (c) non-reciprocity between transmission and reception. Furthermore, the reversibility of such systems has a high reversibility time of the order of 1 millisecond. Other inconveniences are caused by the use of ferrites which provoke burdensome problems of weight and problems of instability with temperature since the operation of ferrite depends on the ambient temperature or the temperature resulting from the microwave energy passed through them.

It is, therefore, an object of this invention to provide a phase shifter of continuous or pseudo-continuous phase variation, which permits, as one will see, the avoidance of the inconveniences of known phase shifters.

Additional objects and advantages of the invention will be set forth in part in the description which follows and, in part, will be obvious from the description or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, the phase shifter of the present invention comprises a microwave line having a wave guide terminated by a short circuit; a plurality of metallic wire conductors fitted in shunt along said guide parallel to a electric field of an electromagnetic wave incident to said wave guide; and diodes in series and mounted in the same sense on at least selected ones of the conductors; the diodes, upon receipt of forward and reverse bias acting on the conduction of the diodes, rendering the wires on which the diodes are mounted continuous or sectioned depending on said bias. Preferably, the wires comprise wire conductors carrying the diodes mounted in series in the same sense and equally spaced, continuous wires without diodes, and additional wires cut into sections. All the wire conductors carrying diodes are preferably mounted in series in the same sense and equally spaced.

In a more narrow sense, the wire conductors are distributed in one or more planes parallel to the sense of propagtion of the incident electromagnetic wave in the interior of the guide, these planes being symmetric with respect to the horizontal axis of the guide. The wire conductors of each plane ideally carry corresponding diodes, the continuous wires and the additional wires are distributed in two planes parallel to the sense of propagation of the incident electromagnetic wave in the interior of said guide, and the planes are symmetric with respect to the axis of the guide and each wire of two corresponding diodes of the planes is placed at the same distance from the short circuit of the wave guide.

BRIEF DESCRIPTION OF THE DRAWINGS

The accompanying drawings, which are incorporated in and constitute a part of this Specification, illustrate a preferred embodiment of the invention and, together with the description, serve to explain the principles of the invention.

DESCRIPTION OF THE PREFERRED EMBODIMENT

Figures 1, 3:
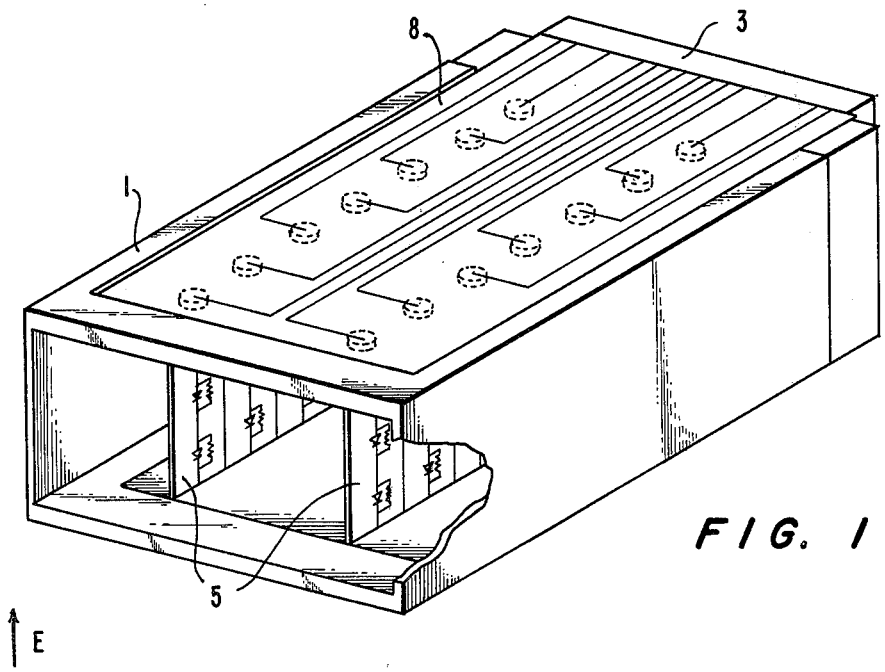
FIG. 1 is an illustration of an assembled phase shifter constructed in accordance with the teachings of the present invention.
FIG. 3 is a table of code commands for the phase shifter of FIG. 1.

Reference will now be made in detail to the present preferred embodiment of the invention, an example of which is illustrated in the accompanying drwings.

A phase shifter according to the present invention comprises a microwave line terminated by a short circuit. The equivalent length of the line can be modified as desired. The microwave line, of which one of the ends is terminated by a short circuit, is composed of a wave guide in which metallic wire conductors carrying from one to several diodes in series are mounted in the same sense at a constant spacing less than the incident wavelength. The wires and diodes are distributed in shunt across the guide parallel to the electric field of the incident electromagnetic wave. That is to say, they are distributed in a plane perpendicular to the longitudinal axis of the guide and parallel to the smaller side of the guide. Additional wire conductors, which are continuous or cut in sections, are mounted parallel to the wires carrying the diodes.

The inventor has, in effect, established that an electromagnetic wave circulating in a waveguide sustains a phase shift when this guide is terminated in a short circuit and there is placed, in shunt and parallel to the electric field of this electromagnetic wave, a metallic wire conductor carrying from one to several diodes in series, mounted in the same sense. The phase shift is a function of the parameters of the wire conductors, of the number of the diodes, of the characteristics of the diodes, of the spacing of the diodes on the wire conductors, of the states of the wires or of the diodes on the wires, and of the distance of the wire conductors carrying the diodes with respect to the short circuit terminating the guide.

It is then possible, with the guide terminated in a short circuit and in which is mounted in shunt a metallic wire conductor carrying the diodes, to modify the phase shift sustained by the electromagnetic wave passing in this guide. This modification of the phase shift is achieved by reversing the state of these diodes on the wires and/or by modifying the distance of these wires with respect to the short circuit. The equivalent effective length of the line is thus modified by the present invention and a variation of the phase difference is thus created with respect to a reference wave.

The inventor has established also that by placing in a wave guide terminated by a short circuit several metallic wire conductors carrying diodes with the wires parallel and at different distances from the short circuit, and by acting as desired on the state of the diodes of one or several wires of diodes through the application of a forward or reverse bias in a way to make them continuous or sectioned, the wave sustains a total phase shift which is not the simple addition of the phase shifts produced by each of the wires if they were alone in the wave guide.

With such a wave guide which is (a) terminated by a short circuit, (b) carrying some metallic wires in shunt and parallel to the electric field of the electromagnetic wave, and (c) carrying some diodes on wires in series, which diodes can be forward or reverse biased by an external voltage command, and (d) carrying some metallic wire conductors which are continuous or sectioned and parallel to the wires of diodes, the present invention provides a phase shifter which, as a function of the state of the diodes on one, or several wires placed at certain distances from the short circuit, will be able to introduce as desired on the incident electromagnetic wave all phase variations as small as the application necessitates.

It must be noted that very small variations of phase shift on the order of two degrees can be obtained by a phase shifter according to the invention consisting of a wave guide terminated in a short circuit with only eight metallic wire conductors carrying diodes, which conductors are judiciously spaced along the length of the guide and supplied with otherwise continuous wire conductors and with sectioned wire conductors.

It should be noted that the continuous metallic wire conductors, those sectioned or those wire conductors which are carriers of diodes, can be either positioned in a plane parallel to the sense of propagation of the wave or in two or several planes parallel to the sense of propagation of the incident wave at the interior of the guide. These planes are preferably symmetric with respect to the horizontal axis of the guide. In this case, two wires of diodes situated at the same distance from the short circuit are applied simultaneously with the same forward or reverse biases, in a way that these two wires are in the same states of being either continuous or sectioned.

Figure 2:
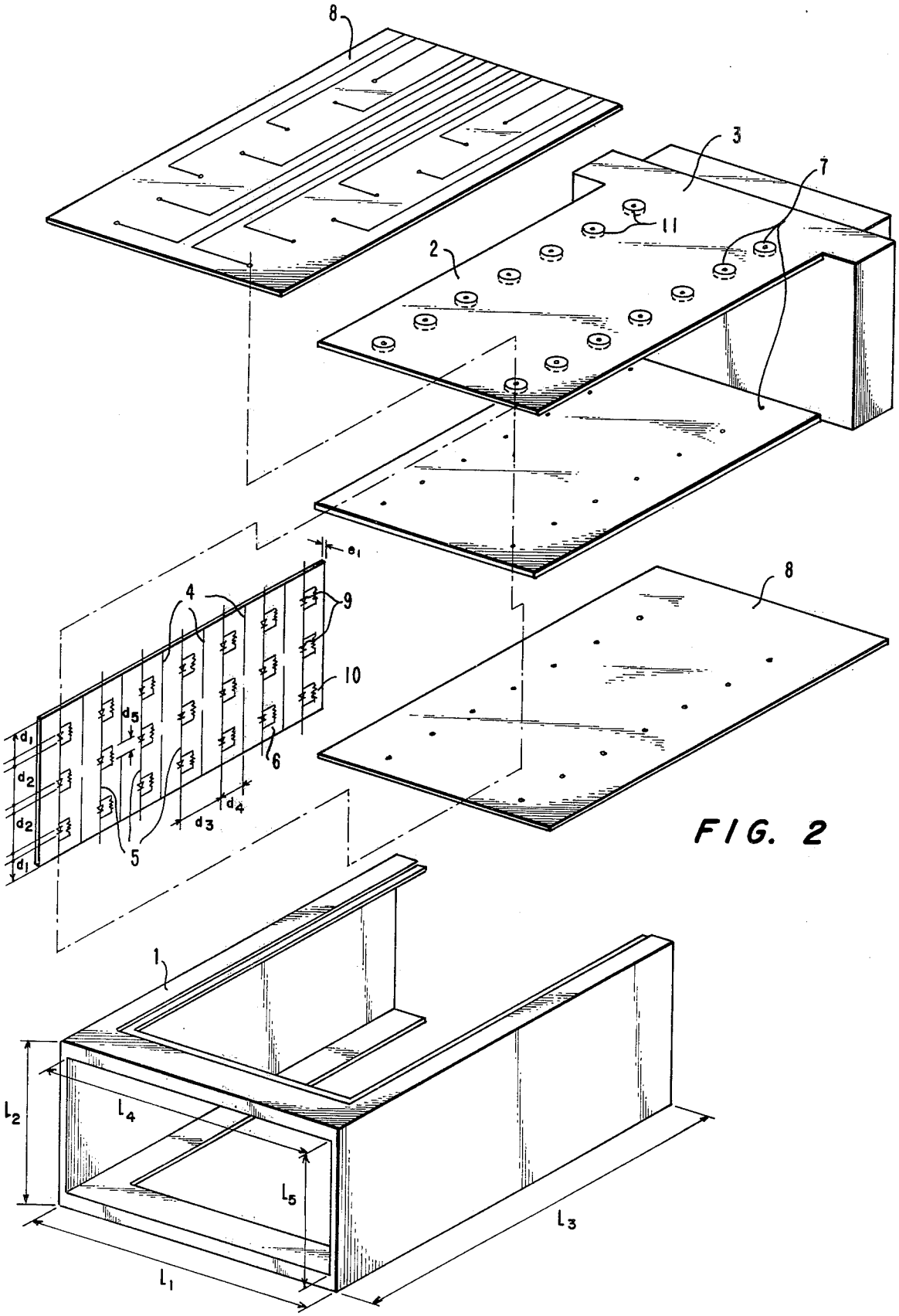
FIG. 2 is an illustration of an unassembled phase shifter of FIG. 1.

By way of example and not limitation reference is made to the drawings in which: FIG. 1 illustrates the assembled phase shifter, and FIG. 2 illustrates the parts making up the phase shifter.

The phase shifter, according to the example illustrated in the drawings, is made up of an element of wave guide of rectangular cross section with exterior dimensions (see FIG. 2) of 78 mm (L1) and 40 mm (L2), and with interior dimensions of 72 mm (L4) and 34 mm (L5). The length of the guide is 64 mm (L3). This guide is made up of two parts which fit together, the first (1) forms the frame, the other (2) designed to adapt to the first, and carries a short circuit (3) as shown in FIG. 2. Six metallic wire conductors (4) are cut in sections and seven metallic wire conductors (5) carry diodes (9) and are aligned alternatively as is shown in FIG. 2 by a glass teflon support (6) of width (e1) of 0.3 mm. The support is preferably constructed by printed circuit methods. The distance (d4) between a sectioned wire and a wire of diodes is 4 mm. The distance (d3) between two wires of diodes is 8.4 mm. Each wire of diodes carries three diodes (9) in series of the thin intrinsic zone type (PIN diode) having 0.22 picofarads of capacitance at 36 Hz and minus 50 volts. The separation (d2) of the diodes on the wire is 11.3 mm. Each diode (9) is furnished with its ballast resistor (10) of 2 megaohms. The sectioned wire conductors have a spacing (d5) of 4.2 mm.

Two glass-telfon supports (6) thus fitted are placed parallel to the smaller sides of the guide at a distance of 36 mm one from the other. The 7 wires (5) carrying the diodes are connected through 28 chokes (11) which are mounted on the two external sides of the part (2) of the guide and fitted equally spaced to the wires (5) of the diodes, to command circuits carried by two integrated circuit plates (8). As shown in FIG. 2, integrated circuit plates (8) are attached on the exterior faces of the part (2) of the guide. The phase shifter which is represented as an assembly in FIG. 1 has been used to phase shift an incident electromagnetic wave of electric field E parallel to the wires in a frequency band of 2850 to 3150 Megahertz.

The inventor has, as an example, successively biased by a forward or reverse voltage command the diodes carried by the seven pairs of wires of diodes according to the code of 38 commands shown in the table of FIG. 3. In FIG. 3, the zero (0) indicates a reverse bias and the one (1) a forward bias. The phase shift of the reflected wave varies from 0 to 360 degrees by elementary steps of 10 degrees in the band of frequencies considered. The insertion loss of the phase shifter is less than 0.5 dB.

Using these seven wire pairs, it is possible to establish up to 128 different commands. In choosing, for example, other command codes for a certain length of band of frequencies, one can obtain a analogous performance of the phase shifter between 2100 and 3900 Megahertz. By adding an eighth pair of wires of diodes analogous to the wires (5), the elementary variation of the phase of the reflected wave is reduced to 2 degrees.

The phase shifter according to the invention presents a number of advantages. It permits a continuous or quasi continuous variation of the phase of an incident electromagnetic wave. It is realizable with components of small cost and of simple technology. It requires simple command voltages. Considering the slight bias currents and the life times of the diodes, the phase shifter has a small switching time. It is reciprocal. It presents insertion losses in the components notably smaller than those observed with known phase shifters. It is adaptable to function at frequencies going to at least 18 GHz and at frequencies between 5 GHz and 18 GHz. It presents less insertion loss than known phase shifters.

The applications of the phase shifter according to the invention are numerous. In particular, by grouping several phase shifters according to the invention and by correctly placing them in front of a microwave beam source, a three dimensional electronic scanning antenna of high performance and very technically interesting is obtained. The antenna thus constructed would be able to emit very high power on the order of 1 KW average per square meter of phase shifters. It will not present quantifable secondary lobes. It will have a very agile pointing ability for the microwave beam due to the very small switching time of the phase shifters, which will allow it to have counter measure applications.

Figure 4:
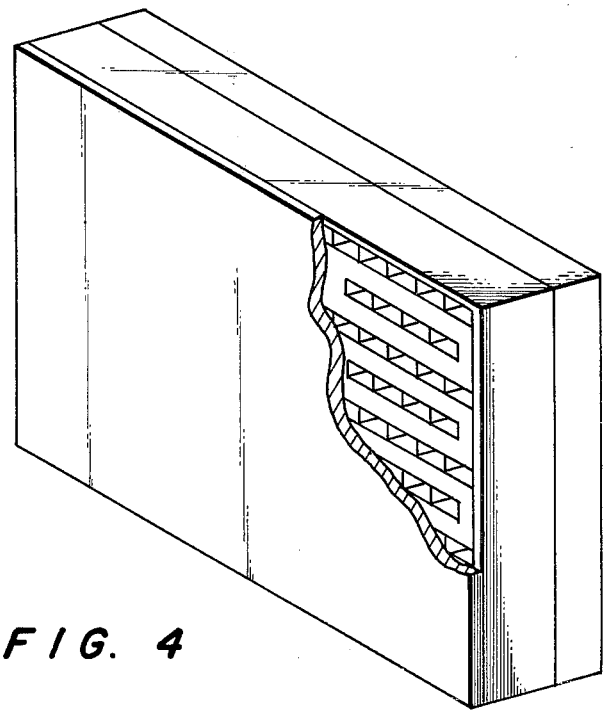
FIG. 4 is a three dimensional electronic scanning antenna.
Figure 5:
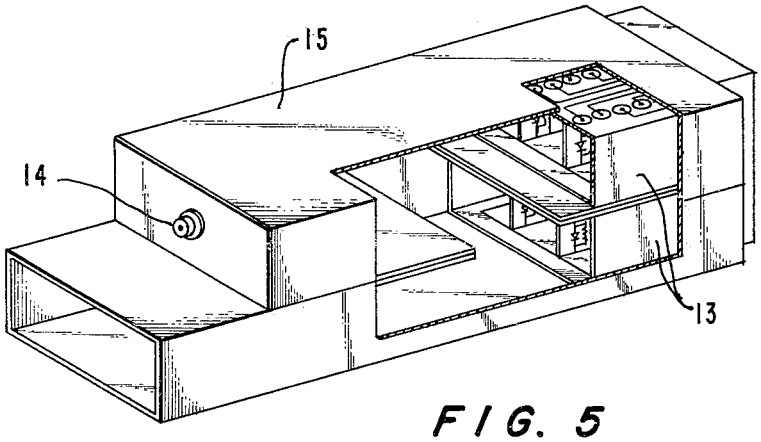
FIG. 5 is a diagram of the assembly of the antenna shown in FIG. 4.

One could equally build a three dimensional electronic scanning antenna of FIG. 4 by joining to a pair of phase shifters 13 as shown in FIG. 5 an individual microwave beam source using connecting part (14) and a 3 dB coupler (15). The assembly FIG. 5 made up of the phase shifter, of the individual source and of the coupler would thus form an assembly working for transmission. One could also build a two dimensional electronic scanning antenna by joining to each of the phase shifters a slotted guide or a dipole fed by a microwave power divider and a 3 dB coupler to make a flat antenna. Each phase shifter and a 3 dB coupler is placed at the end of a slotted guide of the flat antenna.

Figure 6:
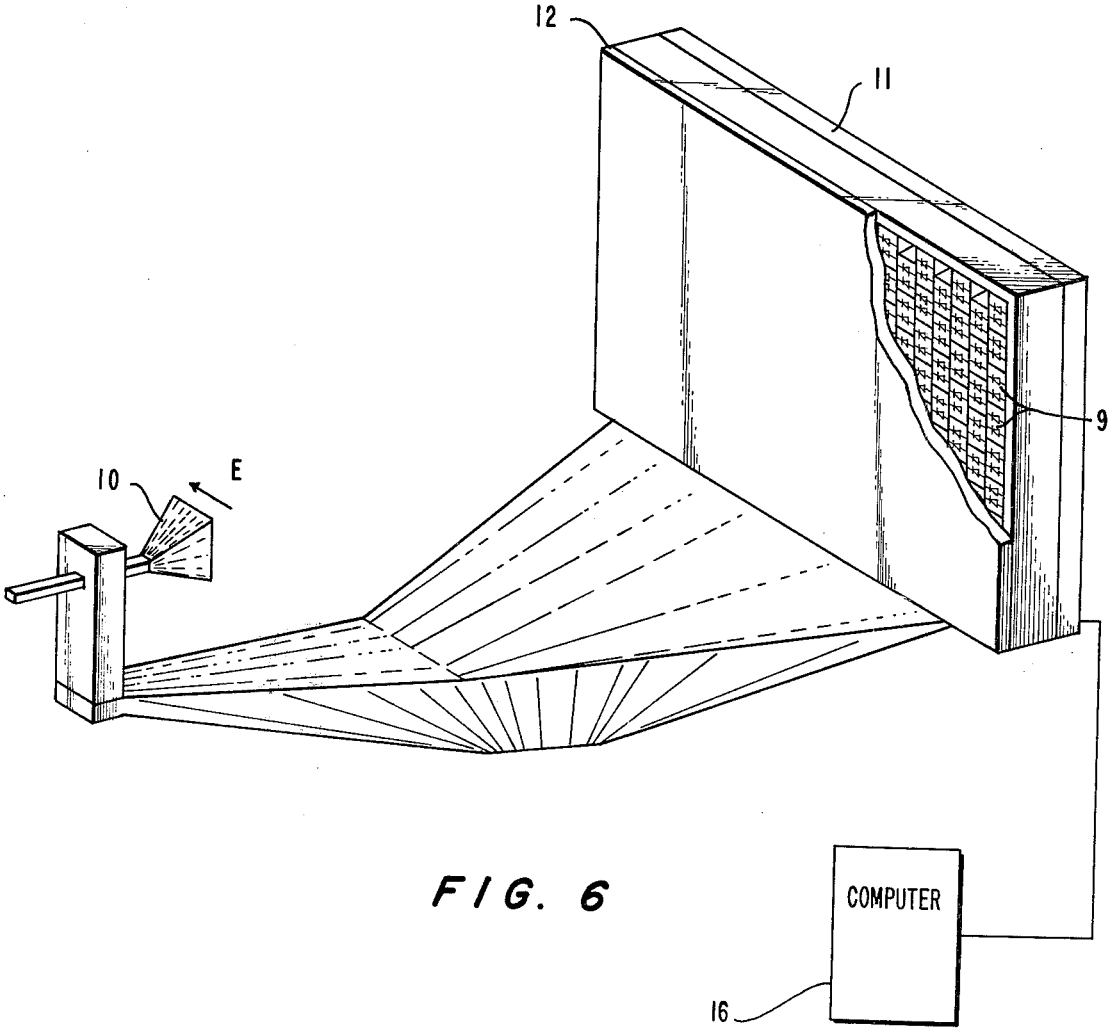
FIG. 6 is another example of an electronic scanning antenna.

For example and for understanding, there is described below an electronic scanning antenna of FIG. 6 destined to operate in the band of 2850–3150 MHz. It is on a surface of 3 meters by 3 meters made up of 2400 diodes as shown in FIG. 6 protected by a dielectric sheet (12) and illuminated by a microwave source (10). As is explained above, the wires of the diodes of each phase shifter shown in FIG. 6 are commanded individually by a command bias voltage, forward or reverse, by means of a computer (16) as a function of the pointing angle desired for the emitted microwave beam. The peak power emitted is 0.9 MW and the average power is 11 kW. The insertion losses are small. The level of the near secondary lobes is less than 30 dB and the level of the diffuse lobes is around 40 dB.

It is possible with this antenna to scan space in a cone of 90 degrees. The cost of such an antenna, given the simplicity of the phase shifters of which it is made and the drive systems (11) which it requires will be extremely small with respect to the cost of antennas achieved by conventional concepts giving lessor performances.

While a particular embodiment of the present invention has been shown and described, it will of course be obvious to one skilled in the art that certain advantages and modifications may be effected without departing from the spirit of the invention, and accordingly, it is intended that the scope of the invention not be determined by the foregoing examples but only by the scope of the appended claims.

I claim:

1. A phase shifter comprising a microwave line having a waveguide terminated by a short circuit; a plurality of metallic conductors positioned parallel to one another within said guide and parallel to the electric field vector of an electromagnetic wave incident to said waveguide; and a plurality of diodes mounted in series and in the same sense on at least selected ones of said conductors; biasing means for selectively providing forward and reverse bias to said diodes, rendering said conductors upon which said diodes are mounted continuous or sectioned depending on said bias; and said conductors being positioned with respect to said short circuit of said wave guide to alter the effective length of said waveguide and selectively shift the phase of said incident electromagnetic wave from 0 to 360 degrees by elementary steps of about 10 degrees or less, as a function of the bias supplied to said diodes.

2. A phase shifter according to claim 1 where said conductors comprise wire conductors carrying said diodes mounted in series in the same sense and equally spaced, continuous wires without diodes, and additional wires cut into sections.

3. A phase shifter according to claim 1 wherein all said conductors carry diodes mounted in series in the same sense and equally spaced.

4. A phase shifter according to claim 2 wherein said wire conductors are distributed in one or more planes each of which is parallel to a plane defined by the electric field vector of said incident electromagnetic wave when moved in the direction of propagation of said incident electromagnetic wave in the interior of said guide, these planes being symmetrically positioned with respect to the longitudinal axis of said guide.

5. A phase shifter according to claim 4 wherein said wire conductors of each plane carry corresponding diodes, said continuous wires and said additional wires are distributed in two planes each of which is parallel to a plane defined by the electric field of said incident electromagnetic wave when moved in the direction of propagation of said incident electromagnetic wave in the interior of said guide, and said planes are symmetric with respect to the longitudinal axis of the guide and each wire of two corresponding diodes of said planes are placed at the same distance from the short circuit of the wave guide.

6. A phase shifter according to claim 5 wherein 14 wire conductors carrying 3 diodes each are divided in two planes.

7. A three dimensional electronic scanning antenna comprising in one plane several phase shifters which are each illuminated by an incident microwave, said phase shifters each comprising a wave guide terminated by a short circuit, a plurality of metallic conductors fitted in shunt along said guide parallel to the electric field vector of said incident microwave, and a plurality of diodes mounted in series and in the same sense on at least selected ones of said conductors; said conductors of each phase shifter being commanded individually by a command bias voltage, forward or reverse, by means of a computer as a function of the pointing angle desired for the emitted microwave beam; and said conductors being positioned with respect to said short circuit of said wave guides to alter the effective length of said wave guides and selectively shift the phase of said incident electromagnetic wave from 0 to 360 degrees by elementary steps of about 10 degrees or less, as a function of the bias supplied to said diodes.

8. A three dimensional electronic scanning antenna according to claim 7 wherein said phase shifters are divided into pairs and each pair is associated with an elementary microwave source.

9. A three dimensional electronic scanning antenna according to claim 7 wherein all said phase shifters are illuminated by a single microwave source.

10. An electronic scanning antenna in one plane comprising a plurality of phase shifters, each of said phase shifters comprising a wave guide terminated by a short circuit, a plurality of parallel conductors positioned in one or more planes longitudinally oriented along said guide parallel to the electric field vector of said incident microwave, and a plurality of diodes mounted in series and in the same sense on at least a selected one of said conductors; all of said phase shifters being excited by a single microwave source; and said conductors being positioned with respect to said short circuit of said wave guide to alter the effective length of said wave guide and selectively shift the phase of said incident electromagnetic wave from 0 to 360 degrees by elementary steps of about 10 degrees or less, as a function of the bias supplied to said diodes.

* * * * *